US011685559B2

(12) United States Patent
Gross

(10) Patent No.: US 11,685,559 B2
(45) **Date of Patent: *Jun. 27, 2023**

(54) STORAGE CONTAINER FOR A STORAGE AND DISPENSING STATION

(71) Applicant: Becton Dickinson Rowa Germany GmbH, Kelberg (DE)

(72) Inventor: Dietmar Gross, Kelberg (DE)

(73) Assignee: Becton, Dickinson Rowa Germany GmbH, Kelberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/835,722

(22) Filed: Jun. 8, 2022

(65) Prior Publication Data

US 2022/0297860 A1 Sep. 22, 2022

Related U.S. Application Data

(63) Continuation of application No. 16/945,475, filed on Jul. 31, 2020, now Pat. No. 11,390,404.

(51) Int. Cl.

| | |
|---|---|
| ***B65D 83/04*** | (2006.01) |
| ***B65B 5/10*** | (2006.01) |
| ***B65B 35/32*** | (2006.01) |
| ***B65B 35/06*** | (2006.01) |

(52) U.S. Cl.

CPC ..... *B65B 5/101* (2013.01); *B65B 35/06* (2013.01); *B65B 35/32* (2013.01); *B65D 83/04* (2013.01)

(58) Field of Classification Search

CPC ..... A61J 7/04; A61J 1/03

See application file for complete search history.

(56) References Cited

U.S. PATENT DOCUMENTS

| | | | |
|---|---|---|---|
| 7,395,946 | B2 | 7/2008 | Yuyama et al. |
| 8,430,269 | B2 | 4/2013 | Nam |
| 8,887,603 | B2 | 11/2014 | Yuyama et al. |
| 11,390,404 | B2 * | 7/2022 | Gross ..... B65B 35/32 |

(Continued)

FOREIGN PATENT DOCUMENTS

| | | | |
|---|---|---|---|
| EP | 3389022 | A1 | 10/2018 |
| WO | WO-2015068973 | A1 | 5/2015 |

OTHER PUBLICATIONS

Extended European Search Report for Application No. 20188877.3, dated Jan. 13, 2021, 12 pages including machine translation.

*Primary Examiner* — Gene O Crawford
*Assistant Examiner* — Ayodeji T Ojofeitimi
(74) *Attorney, Agent, or Firm* — Morgan, Lewis & Bockius LLP

(57) ABSTRACT

A storage container for a storage and dispensing station for drugs or dietary supplement products is provided. The storage container has a separating device including a plurality of channels and a retainer for preventing drugs from slipping into a channel aligned with a dispensing opening. The separating device includes an annular groove and the retainer includes a positioner that engages in the annular groove of the separating device and fixes the retainer vertically. The retainer also includes a retaining section and a holder. The holder secures the retainer against a concurrent rotation with the separating device and aligns the retaining section with the dispensing opening by the holder interacting with a circular cylindrical section of the housing.

20 Claims, 4 Drawing Sheets

(56) References Cited

U.S. PATENT DOCUMENTS

| | | | |
|---|---|---|---|
| 2003/0024944 | A1 | 2/2003 | Chang |
| 2005/0230413 | A1 | 10/2005 | Kim |
| 2008/0116219 | A1 | 5/2008 | Lawrence |
| 2013/0062363 | A1 | 3/2013 | Yuyama et al. |
| 2015/0217929 | A1 | 8/2015 | Morita et al. |
| 2015/0226515 | A1 | 8/2015 | Tseng |
| 2018/0021175 | A1 | 1/2018 | Pellerin et al. |

* cited by examiner

STORAGE CONTAINER FOR A STORAGE AND DISPENSING STATION

CROSS-REFERENCE TO RELATED APPLICATIONS

This Application is a continuation of U.S. patent application Ser. No. 16/945,475, entitled "STORAGE CONTAINER FOR A STORAGE AND DISPENSING STATION," filed on Jul. 31, 2020, which issued as U.S. Pat. No. 11,390,404 on Jul. 19, 2022, the disclosure of which is hereby incorporated by reference in its entirety for all purposes.

BACKGROUND

The present disclosure relates to a storage container for a storage and dispensing station for piece goods, in particular, drugs or dietary supplement products.

SUMMARY

One or more embodiments provide a storage container having a housing enclosing a receiving space for small piece goods and comprising a bottom surface having an opening for dispensing small piece goods, a separating device disposed in the housing and comprising at least one channel configured to receive at least one small piece good, and a retainer. The retainer includes a positioner configured to engage with the separating device and to fix the retainer above the opening, a retaining section, and a holder configured to secure the retainer against a concurrent rotation with the separating device and to align the retaining section with the dispensing opening by the holder interacting with the housing.

One or more embodiments provide a system having a plurality of storage containers wherein at least one storage container includes a housing having a circular cylindrical section, and a bottom surface having an opening for dispensing small piece goods, a separating device disposed in the circular cylindrical section and comprising at least one channel configured to receive at least one small piece good, and a retainer. The retainer includes a positioner configured to engage with the separating device and to fix the retainer above the opening, a retaining section, and a holder configured to secure the retainer against a concurrent rotation with the separating device and to align the retaining section with the dispensing opening.

One or more embodiments provide a method of assembling a storage container for storage and dispensing of small piece goods, the method including coupling a retainer to a separating device with ring sections of a positioner of the retainer, coupling a holder of the retainer with a slide of a holding assembly, inserting the slide into a guide of the holding assembly, the guide disposed in a storage container housing, wherein the slide is slideably movable within the guide, and positioning the coupled separating device, retainer and slide within the storage container housing.

The foregoing and other features, aspects and advantages of the disclosed embodiments will become more apparent from the following detailed description and accompanying drawings.

BRIEF DESCRIPTION OF THE DRAWINGS

One or more embodiments of a storage container for storage and dispensing stations for small piece goods are described below with reference to the accompanying drawing, in which.

DETAILED DESCRIPTION

Figure 1B:
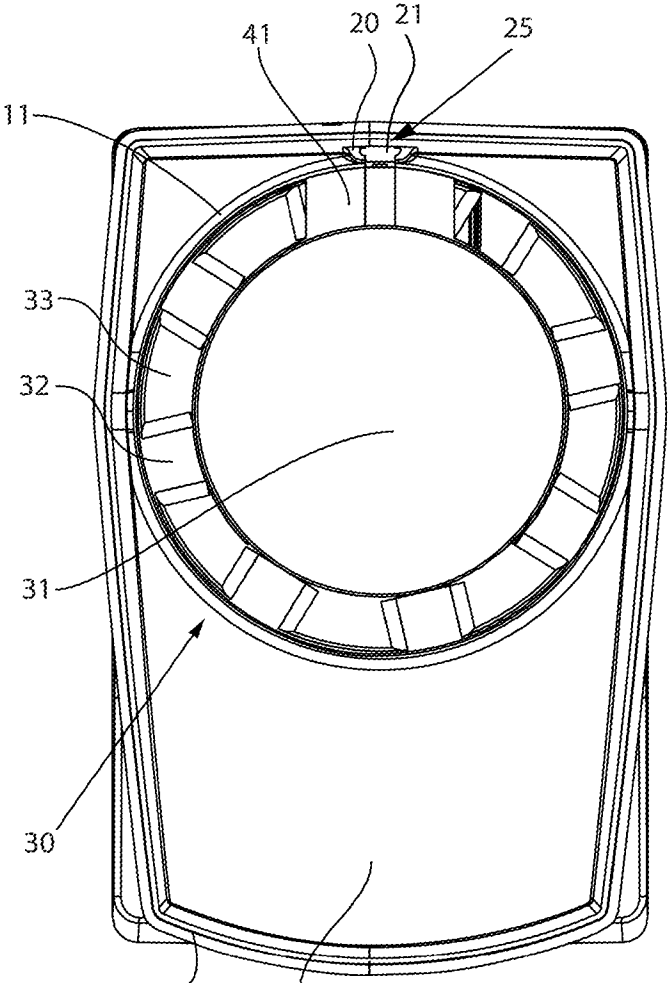
FIG. 1*b* shows a top view of the storage container of FIG. 1, according to aspects of the disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Modern blister packaging machines, as disclosed, for example, in WO 2013/034504 A1, comprise, depending on the level of expansion, several hundred storage and dispensing stations. A plurality of drug portions of a particular drug are stored in each of these, and individual drug portions may be dispensed on request. The drugs stored in the storage and dispensing stations are assembled with the blister packaging machine and blister-packed patient-specifically according to the medically prescribed administration times.

Corresponding storage and dispensing stations for dispensing one or multiple drug portions are activated to assemble the drug portions. When a storage and dispensing station is activated, a separating device which is arranged in the storage container of the storage and dispensing station is used to separate a single drug portion and to transfer it to a guide device of the blister packaging machine via a dispensing opening in the storage container. With the aid of the guide device, a dispensed drug portion, optionally by interposing a collecting device, is fed to a packaging device, which blisters individual or multiple drug portions in accordance with a medical prescription.

To separate the drug portions stored in a storage container of a storage and dispensing station, the separating device comprises a rotor including a plurality of channels, which are usually arranged on the outer circumference of the rotor. The dimensions of the channels must be adapted to the drug portions to be separated in such a way that the drug portions can only be arranged one above the other, but not next to one another, in one channel. The channels may, for example, be dimensioned in such a way that only one drug portion may be accommodated in one channel. To dispense a drug portion from a channel, a channel is moved over the dispensing opening in the bottom surface of the housing of the storage container, and the drug portion situated in the channel (at the lowest point) slides or falls due to gravitational force into the dispensing opening.

In order to prevent additional drug portions stored in or above the channel from also being dispensed, i.e., an unknown number of drug portions from being dispensed, in the area above the dispensing opening a retaining section of a retainer or separator is guided or situated at least in or above the channel that is aligned with the dispensing opening. The retaining section is situated in or above the channel with respect to the height of the channel in such a way that only one drug portion may be situated under the retaining section. If the retaining section is guided into the channel to separate the lowermost drug portion from those situated above it, individual channel-separating projections have a slot which accommodates the retaining section. If the retaining section is situated or guided over the channels, it is guided routinely only slightly over the upper ends of the projections to avoid additional drug portions from entering the channel when the drug portion is dispensed.

Several possibilities are known for storing the retainer on or in the storage container. In one example, a slot is introduced into the side wall of the housing of the storage container, through which the retaining section is guided from the outside into the storage container, specifically, in such a way that the retaining section, depending on the design of the channels, is situated over the channels or in a slot in the channels. As already explained above, the channels, and thus the projections defining the channels, are adapted to the dimensions of the respective drug portions to be separated. This means that the projections have different heights for different drug portions, or the slot is arranged for different housing heights. As a result, the position of the horizontal slot in the housing also depends on the dimensions of the drug portions, so that different housings must be used for different drug portions. In other words, if a storage and dispensing station is to be adapted to a type of drug having different dimensions, both the storage container as well as the separator and the rotor of the separating device must be adapted by the user to the drug product to be separated.

To avoid a housing slot, it is also known to arrange and guide the retainer completely in the storage container. In such a case, however, a change in the type of drug also means that the user changes the separating device and the retainer separately from one another. Both of the aforementioned variants are therefore user-unfriendly as the switch to a type of drug having different dimensions is time-consuming.

It is an object of the present disclosure to provide a storage container for a storage and dispensing station, which may be more quickly adapted to new drug portions and which makes it easier for the user to operate.

The storage container, according to the disclosure, for a storage and dispensing station for small piece goods, in particular, drugs and dietary supplement products, includes a housing enclosing a receiving space for small piece goods including an on the inside circular cylindrical section and a bottom surface having a dispensing opening, a separating device including at least one channel arranged in the circular cylindrical section of the housing for receiving at least one small piece good and including an annular groove for receiving a positioner. The storage container further comprises a retainer including a positioner and a retaining section, the positioner engaging in the annular groove of the separating device and vertically fixing the retainer. In addition, the retainer comprises a holder, which secures the retainer against a concurrent rotation with the separating device and aligns the retaining section with the dispensing opening by the holder interacting with the circular cylindrical section of the housing.

In contrast to the known storage containers and the mechanisms used for arranging the retainer, the present disclosure provides for the retainer to be arranged directly on the separating device. According to the disclosure, the separating device has an annular groove for this purpose, in which the retainer is guided via a positioner. The annular groove and the positioner ensure that the retainer is fixed vertically on the separating device. In order to prevent the retainer from concurrently rotating with the separating device when the separating device rotates, and as a result of which the retaining section is no longer situated above the dispensing opening, the retainer comprises a holder, which interacts with the circular cylindrical section and prevents the retainer from concurrently rotating with the separating device.

When changing the type of drug, it is therefore only necessary in the storage container, according to the disclosure, to release the interaction between the holder and the inside circular cylindrical section and then to remove the separating device together with the retainer from the housing. Another separating device with a retainer already provided may then be inserted. After the retainer has been fixed in place via the holder, the storage and dispensing station may be put into operation immediately. By combining the retainer with the separating device and being able to remove it from the housing as an entire component, the time required for adapting the storage and dispensing station is reduced on the one hand, and on the other hand the change is more convenient for the user, since only one entire component must be removed and reinserted. It is not necessary to insert or introduce the retainer after arranging an adapted separating device in the storage container, according to the disclosure.

Where the annular groove is arranged on or in the separating device depends on the exact design of the storage container, more precisely, on the positioning of the retaining section of the retainer (see above). Two variants are common. In the first variant, the retaining section is positioned above the inlet openings of the channels. In the second variant, the retaining section is guided in a gap, which divides the webs defining the channels (and thus also the channels) into upper and lower web sections (and channel sections). In the first variant, the annular groove is arranged in such a way that the retaining section may be positioned accordingly. In this case, the simplest is probably the arrangement above the inlet openings. In the second variant, the annular groove must be arranged at the height of the gap.

How the interaction between the holder and the circular cylindrical section is produced in such a way that twisting or concurrent rotation of the retainer with the separating device is avoided is not essential to the invention. It is only essential that the concurrent rotation is prevented. This can be done, for example, by the holder being designed as a magnet, which interacts with another magnet inside or outside the housing.

In one or more structurally particularly simple embodiments, it is provided that the holder is designed as a lug and engages in an opening in the circular cylindrical section. Thus, for example, a plurality of openings may be provided, the lug engaging in the opening that is adapted to the height at which the retainer is arranged in the circular cylindrical section. In order to prevent dust from escaping during the operation of the storage and dispensing station, it may be provided that the opening does not penetrate the housing wall.

In one or more embodiments of the storage container according to the disclosure, in which the separating device together with the retainer may be installed particularly conveniently, and which may be used with a large number of drug portions of different dimensions without structural adjustments being necessary, it is provided that a vertically adjustable, radially fixed holder receptacle is situated in the circular cylindrical section, the holder receptacle in turn having an opening into which the holder engages. Because the holder receptacle is vertically adjustable, it slides concurrently with respect to the height, but is radially fixed so that the holder is prevented from concurrently rotating with the separating device.

In order to hold the retainer securely in the annular groove, it is provided in one or more embodiments that the positioner has two ring sections, which engage in the annular groove of the separating device. The retainer is situated between the two ring sections, this construction providing for the secure guidance of the retainer.

After changing the drug portion, it is routinely necessary to clean the separating device and the retainer. For this purpose, the retainer must be separated from the separating device. In order to prevent the retainer from inadvertently detaching from the separating device, it is routinely provided that the ring sections cover more than 180 degrees of an annular surface. In order to simplify the removal of the retainer and to prevent the ring sections from breaking, it is provided in one or more embodiments that the ring sections have recesses which facilitate a spreading apart of the ring sections.

According to the disclosure, the retainer is prevented from concurrently rotating with the separating device. However, in order to ensure that the separating device can be rotated particularly easily in the housing despite the fixed retainer, it is provided in one or more embodiments that the ring sections have projections on the inside which abut the vertical wall of the annular groove.

When separating drug portions, drug dust or drug debris invariably forms due to friction from the drug portions against one another and against components of the storage container, which drug dust or drug debris may settle in the storage container and escape in an undesirable manner. In order to reduce the formation of drug dust in the storage container and to prevent a settling of drug dust in the annular groove, it is provided in one or more embodiments that the ring sections are designed in such a way that they end with one another at their end regions. Here, the annular groove provided in the separating device is thus completely filled by the ring sections and the retainer, so that no drug dust is able to form in the edge regions and the deposition of drug dust in the annular groove is also prevented.

Figure 1A:
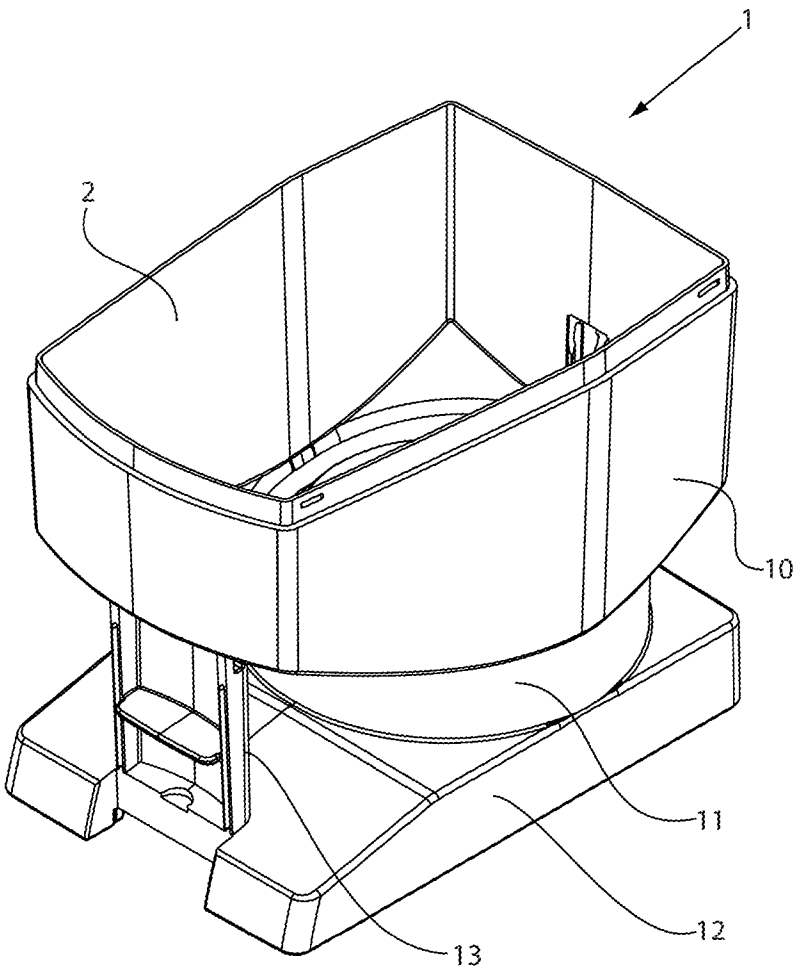
FIG. 1*a* is a perspective view of one or more embodiments of a storage container, according to aspects of the disclosure.

FIG. 1*a* shows a perspective view of one or more embodiments of a storage container 1, according to the disclosure, for a storage and dispensing station. The storage container 1 includes a housing 10 defining a receiving space 2, an inside circular cylindrical section 11 and a base plate 12. For better handling, the storage container 1 also includes a handle 13 in the front area. A cover, usually present when the storage container 1 is in use, has been omitted in order to better illustrate the details inside.

FIG. 1*b* shows a top view of the storage container 1. In the inside circular cylindrical section 11, a separating device 30 having a plurality of projections 33 may be seen, between which channels 32 for drug portions are formed on the outer circumference of the separating device 30. A retaining section 41, which interacts with a vertically adjustable holding assembly 25 via a holder 43 not visible in this view (see FIG. 4), is disposed in the upper section of the storage container 1. This interaction in turn creates an interaction with the housing 10. The vertically adjustable holding assembly 25 includes a guide 20 in which a slide 21 is guided. The slide 21, which as illustrated in the following figures, has an opening 22 in which the holder 43 engages. By engaging around the slide 21 from two sides, the guide 20 radially fixes the slide 21; however, vertical adjustability is ensured.

Figure 2B:
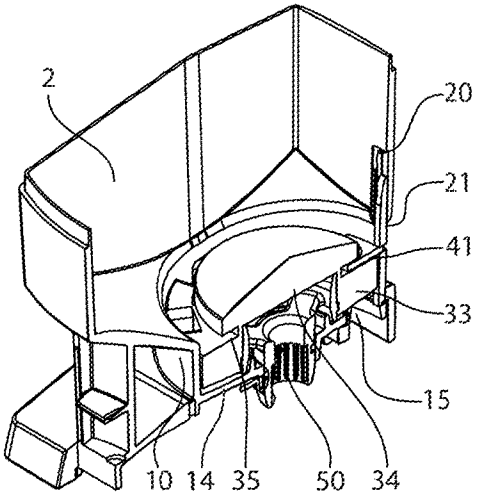
FIGS. 2*a* and 2*b* are partially sectional and sectional perspective views of the storage container of FIG. 1, according to aspects of the disclosure.
Figure 3B:
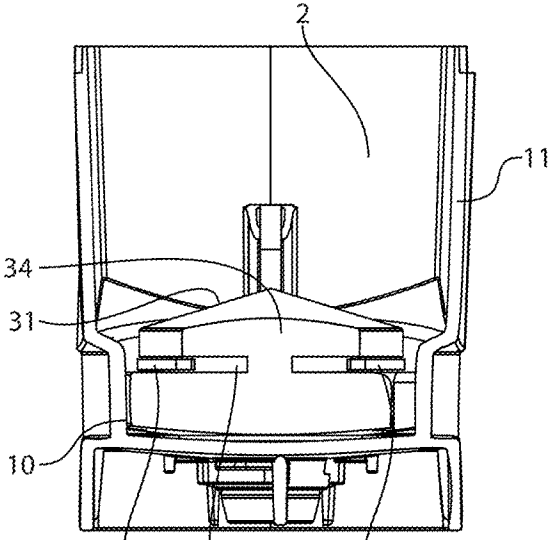
FIGS. 3*a* and 3*b* are a side view and a front sectional view of the storage container of FIG. 1, according to aspects of the disclosure.
Figure 2A:
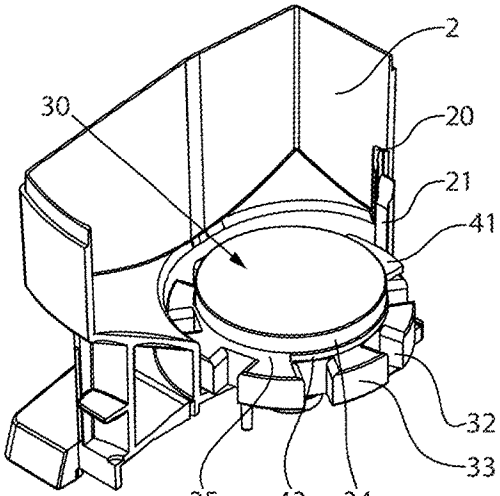
Figure 3A:
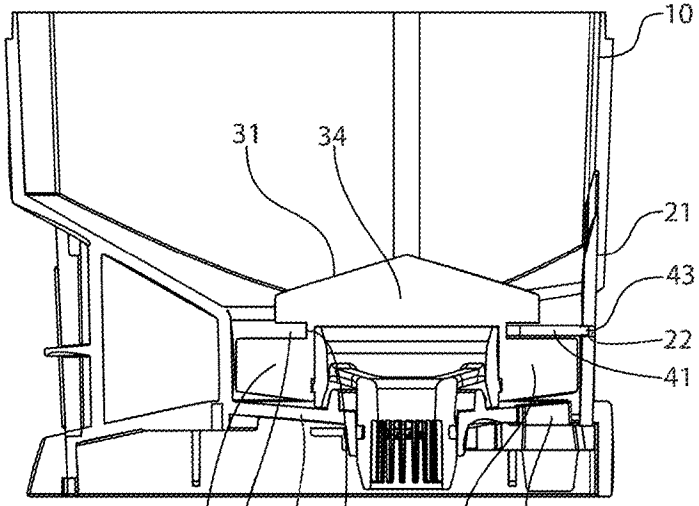

FIGS. 2*a* and 2*b* show a partial sectional view and a sectional view of the storage container 1, and FIGS. 3*a* and 3*b* show a side view and front sectional view of the storage container 1, respectively. In FIGS. 2*a* to 3*b*, it may be seen that the separating device 30 has a conical surface 31, which merges into a cylindrical section 34. This cylindrical section 34 includes an annular groove 35, in which ring sections 46 of a positioner 42 are arranged. As may be seen, in particular, in FIG. 3*b*, the arrangement of the ring sections 46 in the annular groove 35 prevents the positioner 42 itself from being movable vertically on the separating device 30. The positioner 42 is connected to a retaining section 41, as will become clearer in the following figures.

The retaining section 41 is held by a holder 43 above a dispensing opening 15 of the bottom surface 14 of the housing 10. As may be seen, in particular, in FIGS. 2*b* and 3*a*, the separating device 30 includes a coupler 50, via which a coupling may be established between the separating device 30 and a motor (not shown), which may be installed in a control unit (not shown) of the storage and dispensing station (not shown). The control unit is usually detachably connected to a blister packaging machine (not shown), so that it is possible on the one hand to detach the storage and dispensing station, consisting of the storage container 1 and the control unit, from the blister packaging machine, while on the other hand it is also possible to detach the storage container 1 from the control unit (e.g., if the storage container 1 is to be adapted to a new type of drug).

Figure 4:
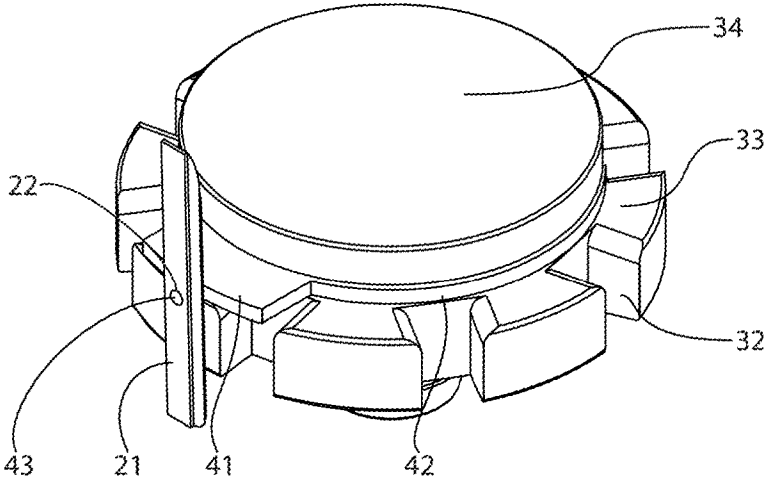
FIG. 4 is a perspective view of a separating device in combination with a retainer, according to aspects of the disclosure.

FIG. 4 shows an oblique view of the combination of the separating device 30 and the retainer 40, and a slide 21 of the vertically adjustable holding assembly 25. As may be clearly seen in FIG. 4, the retainer 40 is held vertically by the ring sections 46 of the positioner 42. In order to prevent a concurrent rotation of the retainer 40, the holder 43 is formed on the retaining section 41, where the holder 43 engages in an opening 22 in the slide 21.

Figure 5:
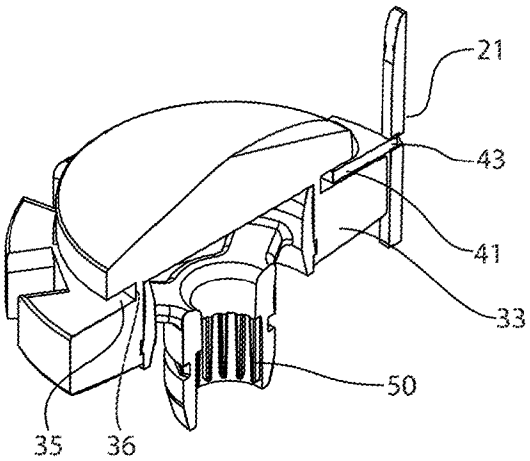
FIG. 5 is a sectional perspective view of the separating device/retainer shown in FIG. 4, according to aspects of the disclosure.

FIG. 5 shows a sectional view of the view shown in FIG. 4 in which, in particular, the engagement of the holder 43 in the opening 22 of the slide 21 may be seen. Furthermore, the coupler 50, with which the separating device 30 may be coupled to the motor of the control unit, may again be seen in FIG. 5. The combination of separating device 30, retainer 40 and slide 21 of the vertically adjustable holding assembly 25 shown in FIGS. 4 and 5 illustrates why these elements are particularly easy to install in the storage container 1.

Figure 7:
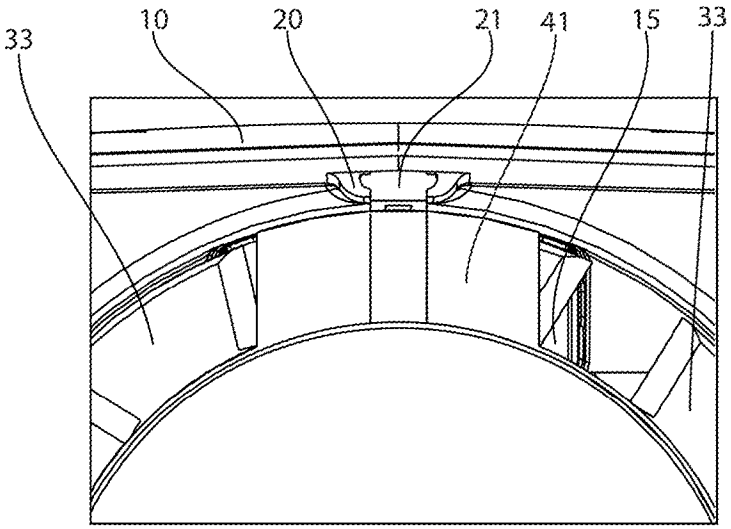
FIG. 7 is a detailed partial top view of the storage container of FIG. 6, according to aspects of the disclosure.
Figure 6:
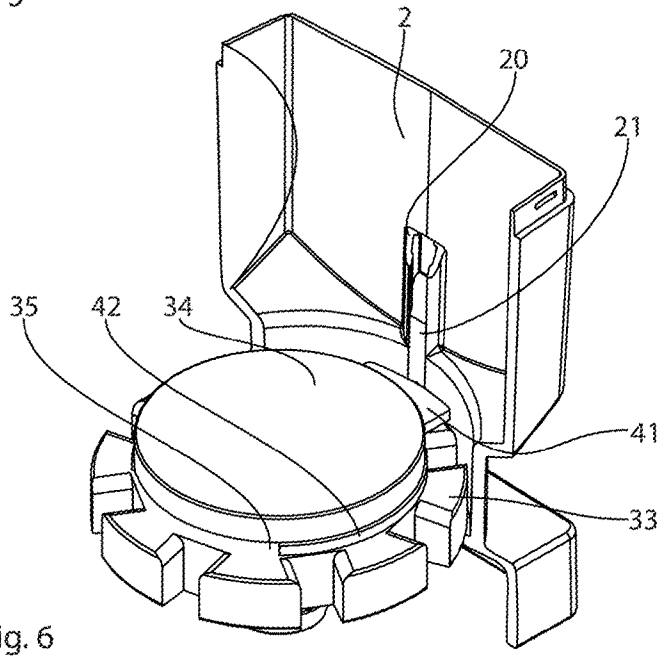
FIG. 6 is a partial sectional perspective view of the storage container of FIG. 1, according to aspects of the disclosure.

The retainer 40 is fixed in the annular groove 35 with the ring sections 46 of the positioner 42. The slide 21 is then fastened to the holder 43 via the opening 22 and the entire assembly is then placed in the storage container 1, with the slide 21 being inserted into the guide 20, which is shown in greater detail in FIGS. 6 and 7. This ensures that the retaining section 41 is always held above the dispensing opening 15 of the bottom surface 14 of the housing 10 of the storage container 1, as indicated in FIG. 7.

Figure 8:
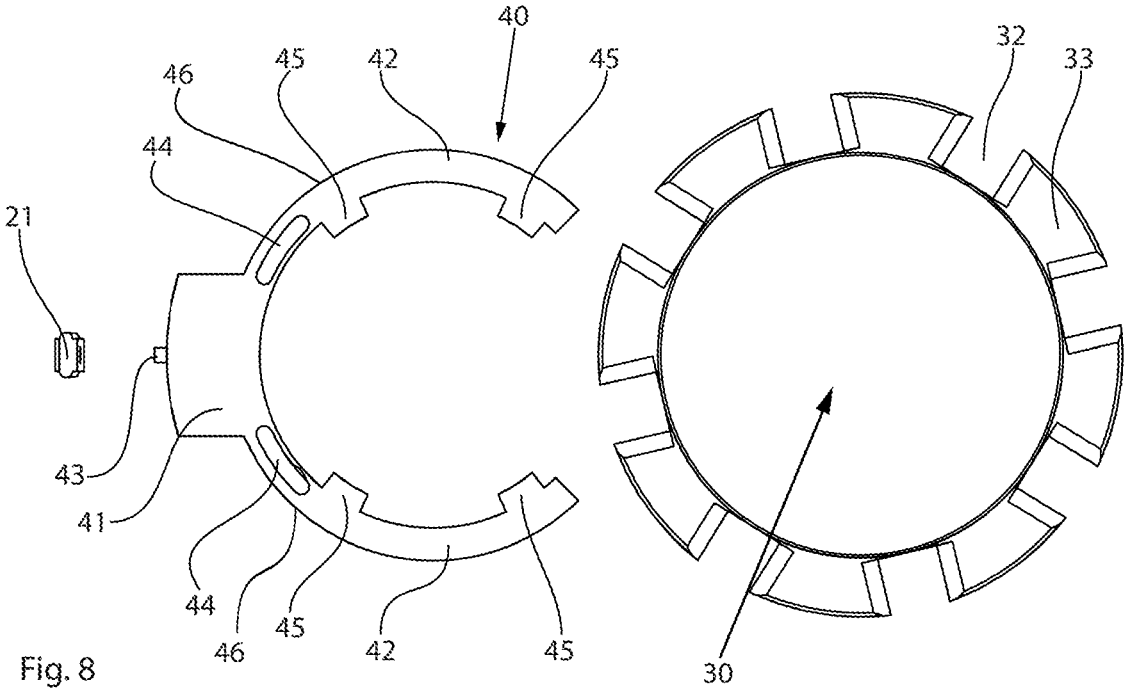
FIG. 8 is a top exploded view of the separating device/retainer shown in FIG. 4, according to aspects of the disclosure.
Figure 9:
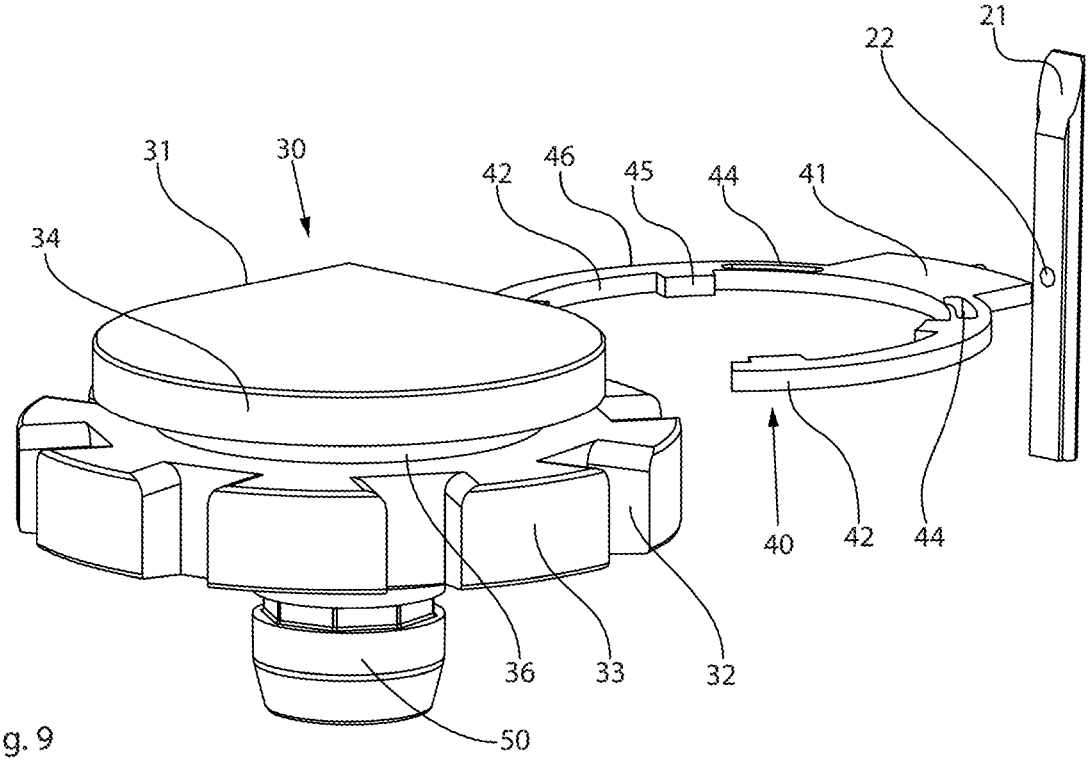
FIG. 9 is a perspective exploded view of the separating device/retainer shown in FIG. 8, according to aspects of the disclosure.

FIGS. 8 and 9 show two exploded views of the combination shown in FIG. 4, FIG. 8 showing a top view and FIG. 9 showing an oblique view. As may be discerned from FIGS. 8 and 9, the positioner 42 may be implemented by the two ring sections 46, which enclose (e.g., are adjacent to) the retaining section 41. On the retaining section 41, the holder 43 is designed in the form of a lug, which is able to interact with the opening 22 in the slide 21, this interaction preventing the retainer 40 from twisting or concurrently rotating in the annular groove 35. The ring sections 46 of the positioner 42 may each include two projections 45, which abut the inner wall 36 of the annular groove 35 when the retainer 40 is inserted. The ring sections 46 have recesses 44 that facilitate a spreading apart of the ring sections 46.

FIG. 9 shows the coupler 50 again, via which the separating device 30 may be coupled to a motor unit in the control unit of a storage and dispensing station.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed:

1. A storage container comprising:

a housing enclosing a receiving space for small piece goods and comprising a bottom surface having an opening for dispensing small piece goods;

a separating device disposed in the housing and comprising at least one channel configured to receive at least one small piece good; and a retainer comprising:

a positioner configured to engage with the separating device and to fix the retainer above the opening;

a retaining section; and a holder configured to secure the retainer against a concurrent rotation with the separating device and to align the retaining section with the dispensing opening by the holder interacting with the housing.

2. The storage container of claim 1, wherein the holder is a lug configured to engage with an opening in the housing.

3. The storage container of claim 1, further comprising a holding assembly arranged in the housing, the holding assembly comprising an opening in which the holder is configured to engage.

4. The storage container of claim 3, wherein the holding assembly comprises a guide and a slide movably disposed in the guide.

5. The storage container of claim 4, wherein the guide engages both a radial inner surface of the slide and a radial outer surface of the slide to fix the slide radially with respect to the separating device.

6. The storage container of claim 4, wherein the slide is adjustable within the guide.

7. The storage container of claim 1, wherein the positioner comprises two ring sections each configured to engage in a groove of the separating device.

8. The storage container of claim 7, wherein the ring sections each comprise a recess configured to facilitate a spreading of the ring sections.

9. The storage container of claim 7, wherein the ring sections each comprise a projection disposed on an inside surface of the ring section.

10. The storage container of claim 9, wherein the projections abut a vertical wall of the groove.

11. The storage container of claim 7, wherein the ring sections are configured to touch one another at end regions.

12. The storage container of claim 7, wherein the ring sections and the retaining section fill the groove.

13. The storage container of claim 12, wherein the ring sections and the retaining section are configured to prevent dust from drug portions from being deposited in the groove.

14. A system having a plurality of storage containers, at least one storage container comprising:

a housing comprising:

a circular cylindrical section: and a bottom surface having an opening for dispensing small piece goods;

a separating device disposed in the circular cylindrical section and comprising at least one channel configured to receive at least one small piece good; and a retainer comprising:

a positioner configured to engage with the separating device and to fix the retainer above the opening;

a retaining section; and a holder configured to secure the retainer against a concurrent rotation with the separating device and to align the retaining section with the dispensing opening.

15. The system of claim 14, the at least one storage container further comprising a holding assembly arranged in the circular cylindrical section, the holding assembly comprising:

a guide;

a slide movably disposed in the guide; and an opening in the slide, the opening configured to couple with the holder.

16. The system of claim 15, wherein the guide engages both a radial inner surface of the slide and a radial outer surface of the slide to fix the slide radially with respect to the separating device, and wherein the slide is adjustable within the guide.

17. The system of claim 14, wherein the positioner comprises two ring sections each configured to engage in a groove of the separating device.

18. The system of claim 17, wherein each ring section comprises:

a recess configured to facilitate a spreading of the ring section; and a projection configured to abut a vertical wall of the groove.

19. The system of claim 18, wherein the ring sections are configured to touch one another at end regions, and wherein the ring sections and the retaining section fill the groove and prevent drug dust from being deposited in the groove.

20. A method of assembling a storage container for storage and dispensing of small piece goods, the method comprising:

coupling a retainer to a separating device with ring sections of a positioner of the retainer;

coupling a holder of the retainer with a slide of a holding assembly;

inserting the slide into a guide of the holding assembly, the guide disposed in a storage container housing, wherein the slide is slideably movable within the guide; and positioning the coupled separating device, retainer and slide within the storage container housing.

* * * * *